US012158048B1

(12) United States Patent
Maher et al.

(10) Patent No.: US 12,158,048 B1
(45) Date of Patent: Dec. 3, 2024

(54) DEBRIS CAPTURING MAGNET WITH REAL TIME DEBRIS CAPACITY MONITORING

(71) Applicant: Halliburton Energy Services, Inc., Houston, TX (US)

(72) Inventors: Peter Reid Maher, Lafayette, LA (US); Stefano Cappiello, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/203,983

(22) Filed: May 31, 2023

(51) Int. Cl.
*E21B 31/06* (2006.01)
*E21B 47/12* (2012.01)

(52) U.S. Cl.
CPC ..... *E21B 31/06* (2013.01); *E21B 47/12* (2013.01)

(58) Field of Classification Search
CPC ..... E21B 31/06; E21B 47/12; E21B 37/00; E21B 27/00; B03C 1/30
See application file for complete search history.

(56) References Cited

U.S. PATENT DOCUMENTS 5,214,377 A * 5/1993 Maurice ..... G01V 3/08 250/225
5,675,249 A * 10/1997 LaClair ..... G01N 1/34 324/202
8,672,025 B2 3/2014 Wolf et al.
8,800,660 B2 8/2014 Fishbeck et al.
10,072,473 B2 9/2018 Rud
11,519,232 B1 12/2022 Aldughaither
2002/0057151 A1* 5/2002 Ruttley ..... E21B 31/06 335/207
2009/0091328 A1* 4/2009 Clark ..... G01V 3/28 324/338
2014/0096972 A1* 4/2014 Leiper ..... E21B 37/00 166/66.5
2015/0019200 A1* 1/2015 Woodward ..... G06F 40/47 704/2
2015/0122480 A1* 5/2015 Sullivan ..... E21B 31/06 166/66.5
2016/0370275 A1 12/2016 Weiser
(Continued)

FOREIGN PATENT DOCUMENTS

EP 0517481 A2 2/1992
GB 2468972 A 3/2009
NO 343843 B1 10/2012

OTHER PUBLICATIONS

Foreign Communication from Related Application—International Search Report and Written Opinion of the International Searching Authority, International Application No. PCT/US2023/023994, dated Feb. 22, 2024, 10 pages.

*Primary Examiner* — Daniel P Stephenson
(74) *Attorney, Agent, or Firm* — Conley Rose, P.C.; Rodney B. Carroll

(57) ABSTRACT

A wellbore magnet tool including a plurality of magnets positioned about an outer circumference of the wellbore magnet tool; a plurality of sensors, including: a first sensor proximal one or more of the plurality of magnets; and a second sensor positioned downhole from the first sensor, and an electronics board. The first sensor and the second sensor are electronically connected with the electronics board, and the first sensor and the second sensor detect changes in a magnetic field proximate thereto, which changes result from debris collection by the wellbore magnet tool.

28 Claims, 8 Drawing Sheets

(56) References Cited

U.S. PATENT DOCUMENTS

| | | | | |
|---|---|---|---|---|
| 2017/0370178 | A1* | 12/2017 | Budler | E21B 47/138 |
| 2021/0246762 | A1* | 8/2021 | Paton | E21B 31/06 |
| 2021/0285301 | A1* | 9/2021 | Maher | E21B 31/06 |
| 2021/0332672 | A1 | 10/2021 | Leiper et al. | |
| 2022/0136354 | A1 | 5/2022 | Garcia | |
| 2022/0213744 | A1* | 7/2022 | Al Ahmari | E21B 31/06 |

* cited by examiner

DEBRIS CAPTURING MAGNET WITH REAL TIME DEBRIS CAPACITY MONITORING

FIELD

The present disclosure relates generally to wellbore magnet tools. More specifically, the disclosure relates to a wellbore magnet tool that enables monitoring of a remaining debris collection capacity of the wellbore magnet tool, substantially in real time. Still more specifically, the disclosure relates to a wellbore magnet tool and methods of making and using same that utilize one or more sensors to detect strength of local magnetic fields and thereby enable monitoring of the remaining debris collection capacity of the wellbore magnet tool.

BACKGROUND

Downhole magnets (also referred to herein as "downhole magnet tools") are frequently utilized for recovering large amounts of swarf or other ferrous materials, for example millings generated during milling operations, such as milling a window in casing. Conventional downhole magnets are simple tools, provide no information as to how much debris has been collected by the tool or how much more debris collection capacity is remaining.

BRIEF DESCRIPTION OF DRAWINGS

For a more complete understanding of this disclosure, reference is now made to the following brief description, taken in connection with the accompanying drawings and detailed description, wherein like reference numerals represent like parts. The following figures are included to illustrate certain aspects of the present disclosure, and should not be viewed as exclusive embodiments. The subject matter disclosed is capable of considerable modification, alteration, and equivalents in form and function, as will occur to one having ordinary skill in the art and having the benefit of this disclosure.

DETAILED DESCRIPTION

Figure 1A:
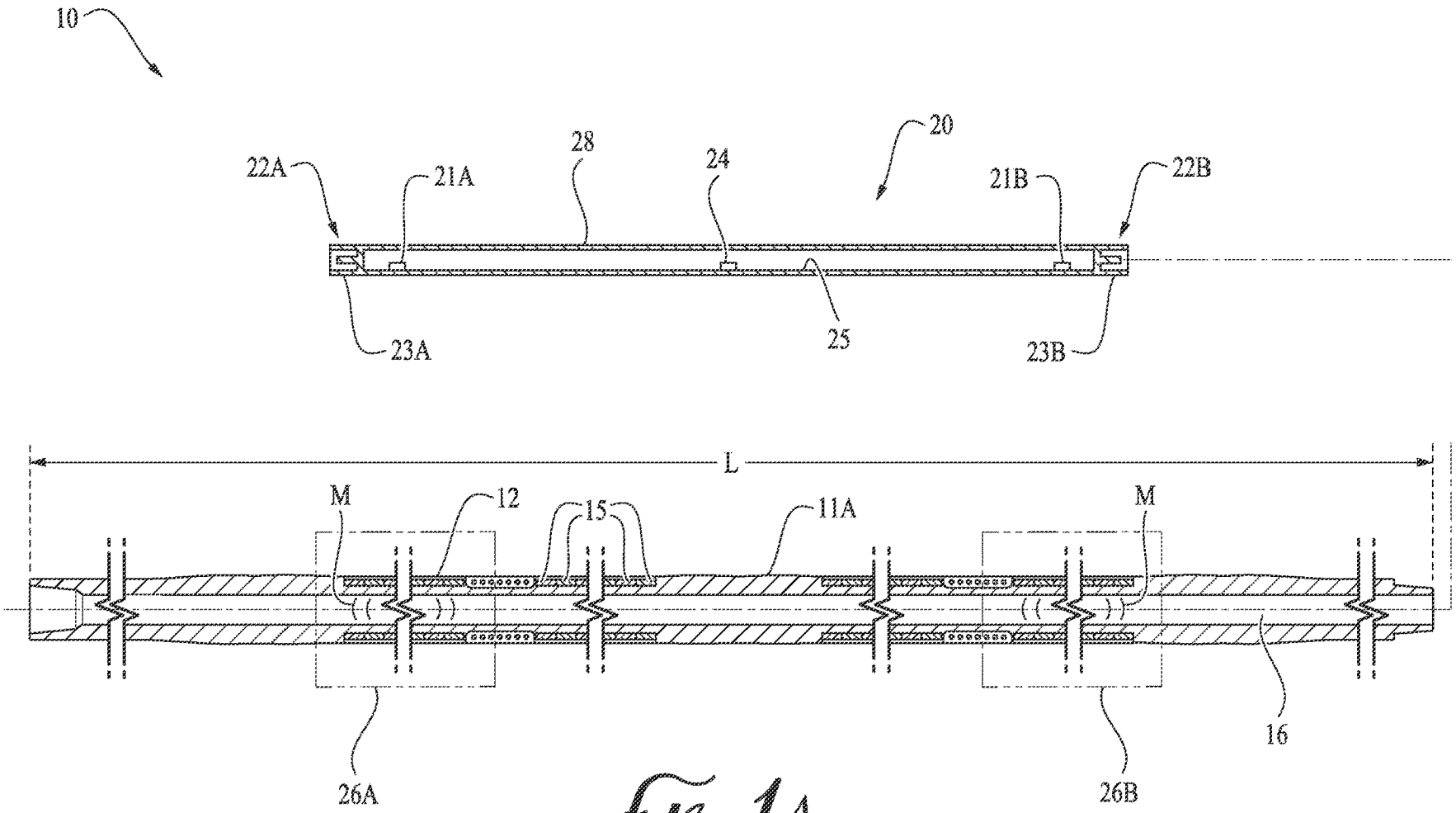
FIG. 1A is a schematic illustration of a deconstructed wellbore magnet tool, according to embodiments of this disclosure.

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

It is to be understood that "subterranean formation" encompasses both areas below exposed earth and areas below earth covered by water such as ocean or fresh water. Herein in the disclosure, "top" means the well at the surface (e.g., at the wellhead which may be located on dry land or below water, e.g., a subsea wellhead), and the direction along a wellbore towards the well surface is referred to as "up" or "uphole"; "bottom" means the end of the wellbore away from the surface, and the direction along a wellbore away from the wellbore surface is referred to as "down" or "downhole" For example, in a horizontal wellbore, two locations may be at the same level (i.e., depth within a subterranean formation), the location closer to the well surface (by comparing the lengths along the wellbore from the wellbore surface to the locations) is referred to as "above" or "uphole" relative to the other location, the location farther away from the well surface (by comparing the lengths along the wellbore from the wellbore surface to the locations) is referred to as "below" or "lower than" or "downhole" relative to the other location. An uphole end of a tool can be referred to herein as a "top" of the tool, and a downhole end of the tool can be referred to herein as a "bottom" of the tool.

A subterranean formation containing oil or gas hydrocarbons may be referred to as a reservoir, in which a reservoir may be located on-shore or off-shore. Reservoirs are typically located in the range of a few hundred feet (shallow reservoirs) to tens of thousands of feet (ultra-deep reservoirs). To produce oil, gas, or other fluids from the reservoir, a well is drilled into a reservoir or adjacent to a reservoir.

A well can include, without limitation, an oil, gas, or water production well, or an injection well. As used herein, a "well" includes at least one borehole (also referred to as a "wellbore") having a borehole wall (also referred to herein as a "wellbore wall"). A borehole can include vertical, inclined, and horizontal portions, and it can be straight, curved, or branched. As used herein, the term "borehole" includes any cased, and any uncased, open-hole portion of the borehole. Further, as noted above, the term "uphole" refers a direction that is towards the surface of the well along the borehole, while the term "downhole" refers a direction that is away from the surface of the well along the borehole.

Percentages set forth in the specification are weight percentages except as otherwise indicated.

As noted above, downhole magnets are frequently utilized for recovering large amounts of swarf generated during milling operations, such as milling a window in casing. Since these are very simple tools, there is conventionally no way to know how much debris has been collected and how much more collection capacity is remaining.

Herein disclosed are magnet tools comprising sensors (e.g., at the top of the tool and the bottom of the tool). The sensors can each be located near some of the raw magnets that are collecting the debris, and can detect direct gauss readings or be magnetometers for measuring interference or utilize another method of detecting changes in magnetic field local to (e.g., proximal) the sensor. Readings from the sensors can be transmitted to the surface, for example via connection to a measuring while drilling (MWD) tool and surface acquisition systems, or through wired drill pipe (WDP), in embodiments.

Since magnets are always on, the wellbore magnet tool can collect debris first at the bottom (e.g., a downhole end) of the tool. As more debris is collected, areas at the bottom of the tool can reach maximum capacity for debris collection and subsequently cease collecting debris, while other areas of the wellbore magnet tool (e.g., areas closer to an uphole end of the wellbore magnet tool) can continue collecting debris until the debris collection capacity of the magnets at this end of the wellbore magnet tool have also reached maximum debris collection capacity. Collecting the debris will alter the magnetic field measurements experienced by the sensors. Positioning a plurality of sensors, including at least a first sensor at the bottom or downhole end of the wellbore magnet tool and a second sensor at the top or uphole end of the wellbore magnet tool can enable a method to monitor the debris collection, substantially in real time, and allow for estimations as to when the wellbore magnet tool(s) are full or close to full (e.g., have reached maximum debris collection capacity) and thus unable to recover any additional debris. Having at least two points for comparison also provides for an element of qualitative value to the measurement, since a measurement that would have quantitative value (e.g., estimates to how much debris is actually disposed/collected on the wellbore magnet tool) can be be difficult and can vary significantly depending on wellbore fluids, temperatures, and debris particle sizes, etc. For example, large particles generally result in a higher maximum recovery, while smaller particles generally result in a lower maximum recovery.

Description of a wellbore magnet tool of this disclosure will now be made with reference to FIG. 1A, which is a schematic illustration of a deconstructed wellbore magnet tool 10, according to embodiments of this disclosure; FIG. 1B, which is a schematic of a bottom hole assembly (BHA) comprising a wellbore magnet tool 10 of this disclosure; FIG. 2A which is a zoomed in view of a section of the wellbore magnet tool 10, showing some of a plurality of magnets 15 in the wellbore magnet tool 10; FIG. 2B, which is a schematic illustration of a cross section of the wellbore magnet tool 10 taken along section A-A of FIG. 2A, according to embodiments of this disclosure; and FIG. 2C, which is a schematic illustration of a cross section of a wellbore magnet tool 10 taken along section A-A of FIG. 2A, according to other embodiments of this disclosure.

A wellbore magnet tool 10 of this disclosure comprises a plurality of magnets 15 positioned about an outer circumference 14 of the wellbore magnet tool 10; a plurality of sensors 21, including: a first sensor 21A proximal one or more of the plurality of magnets 15; and a second sensor 21B positioned downhole from the first sensor 21A and proximal one or more other of the plurality magnets 15; and an electronics (e.g., processing) board 24. The first sensor 21A and the second sensor 21B are electronically connected with the electronics board 24. The plurality of sensors 21 (e.g., the first sensor 21A and the second sensor 21B) are able to detect changes in a magnetic field M proximate thereto (e.g., a "local" magnetic field), which changes result from debris 36 collection by the wellbore magnet tool 10. (For simplicity, the local magnetic field proximal the sensors is depicted and referred to simply as magnetic field "M", although the local magnetic field can and will vary depending on the location and arrangement of magnets 15, and the amount of debris 36 collected on the magnets 15 local to each sensor 21.)

The swarf or debris (36, FIG. 1B) can include any ferrous material, such as, without limitation, window millings, slips recovery (during fishing runs), shackles or pins, or the like. Although described hereinbelow with regard to milling operations, the wellbore magnet tool 10 of this disclosure can be employed to collect magnetic/ferrous debris of any type, and is not limited to collect millings.

Figure 1B:
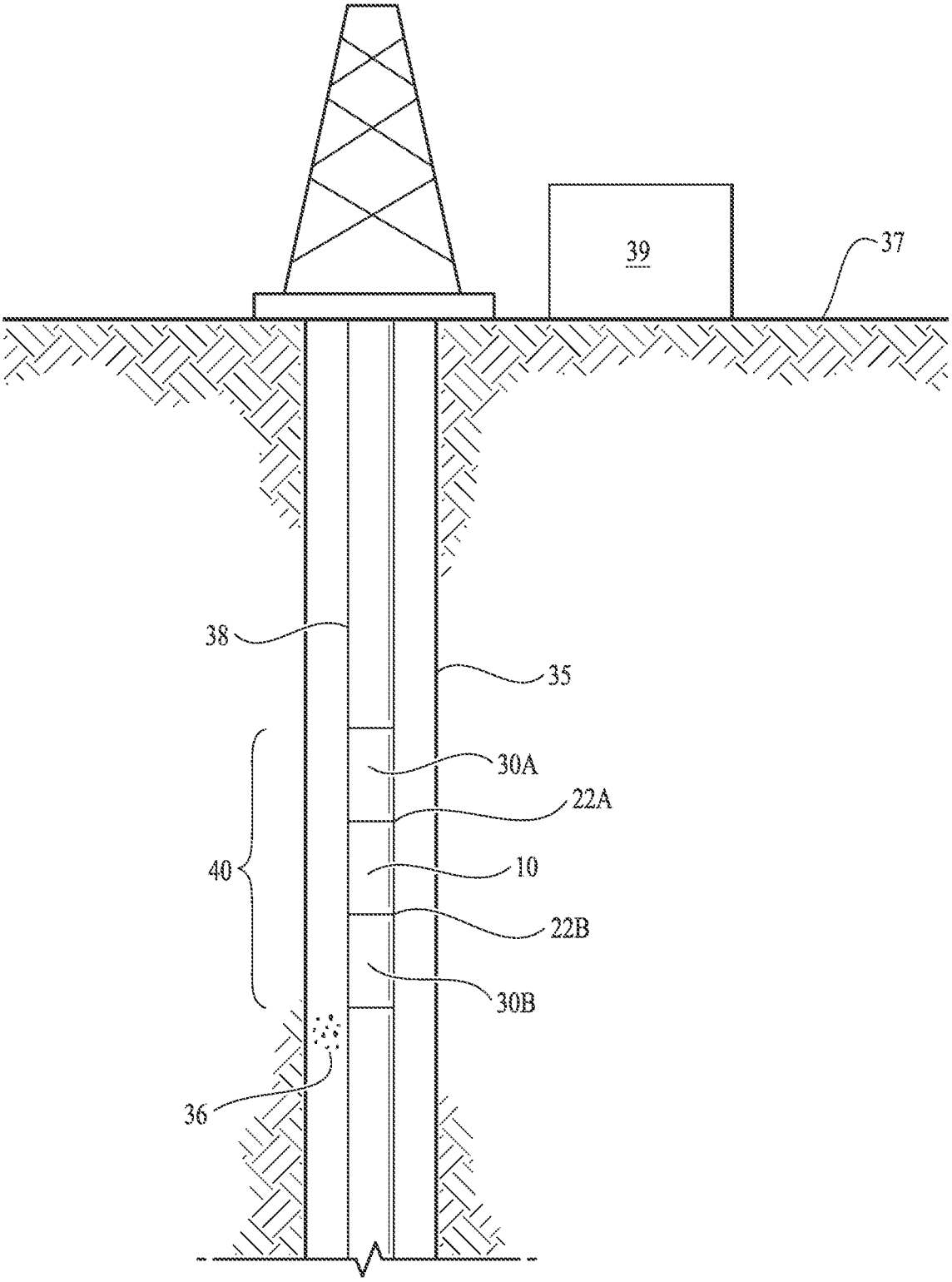
FIG. 1B is a schematic of a bottom hole assembly (BHA) comprising a wellbore magnet tool 10 of this disclosure.
Figure 2A:
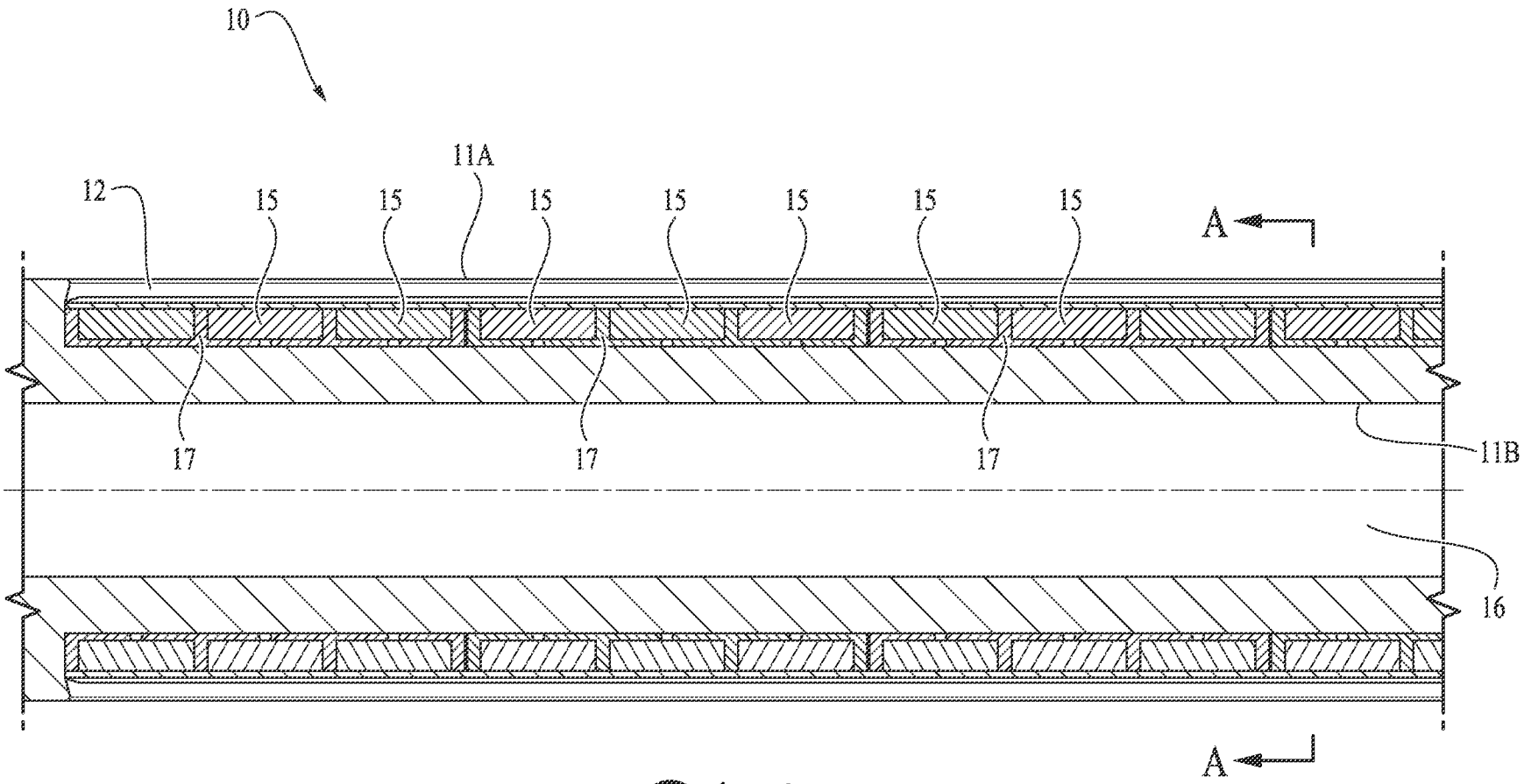
FIG. 2A is a close-up view of a section of the wellbore magnet tool of FIG. 1, showing some of a plurality of magnets in the wellbore magnet tool.
Figure 2B:
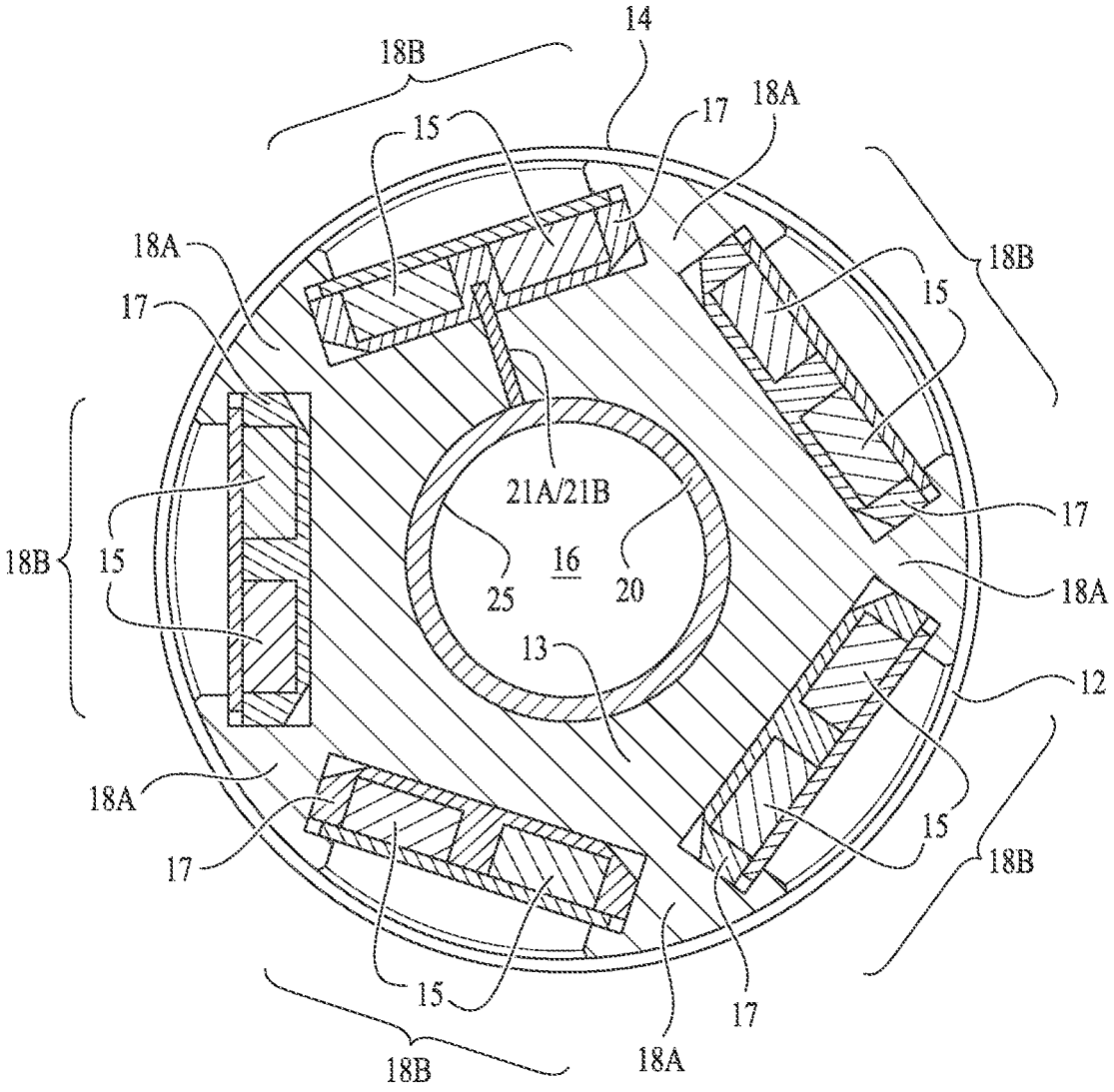
FIG. 2B is a schematic illustration of a cross section of a wellbore magnet tool, according to embodiments of this disclosure.

As depicted in the embodiment of FIG. 1A, the wellbore magnet tool 10 can comprise a chassis 20. The chassis 20 can be substantially cylindrical (e.g., comprising a thin cylindrical wall 28), and can be positioned within an interior flow bore 16 of the wellbore magnet tool 10. The plurality of sensors 21 (e.g., the first sensor 21A, the second sensor 21B), and/or the electronics board 24 can be connected (e.g., physically, mechanically connected) to the chassis 20, in embodiments. For example, in embodiments, the first sensor 21A, the second sensor 21B, the electronics board 24, or a combination thereof can be positioned or attached to an inside surface 25 of the chassis 20. Wires can electronically connect each of the plurality of sensors 21 (e.g., the first sensor 21A and the second sensor 21B) with the electronics board 24.

In embodiments, the chassis 20 can be removably positioned in the interior flow bore 16 of the wellbore magnet tool 10, as further described hereinbelow, such that the plurality of sensors 21, the electronics board 24, or a combination thereof can be inserted into the flow bore 16 of the wellbore magnet tool 10 via insertion of the chassis 20 into the wellbore magnet tool 10 and can, subsequent use, optionally be removed from the wellbore magnet tool 10 by removal of the chassis 20 therefrom.

As depicted in FIG. 1A, the first sensor 21A can be positioned in a first sensor location 26A that is uphole from the second sensor 21B, which can be positioned in a second sensor location 26B. For example, the first sensor 21A can be positioned proximal a first (e.g., uphole, box) end 22A of the wellbore magnet tool 10 and the second sensor 21B can be positioned proximal a second (e.g., downhole, pin) end 22B of the wellbore magnet tool 10.

Desirably, at least two sensors 21 are utilized. In embodiments, the plurality of sensors 21 comprises one or more additional sensors 21 in addition to the first sensor 21A and the second sensor 21B. In such embodiments, the one or more additional sensors 21 are electronically connected with the electronics board 24. Like first sensor 21A and second sensor 21B, the one or more additional sensors 21 can be configured to detect changes in a magnetic field M proximate thereto, which changes result from debris collection by the wellbore magnet tool 10. Utilizing a distribution of the plurality of sensors 21 along the length L of the wellbore magnet tool 10 can enable better approximation of an extent of debris 36 collection capacity remaining on the wellbore magnet tool 10. For example, the sensors 21 can be monitored, and as the sensors 21 reach maximum capacity (e.g., and no longer register a change in magnetic field M strength), an estimate of the remaining debris 36 collection capacity can be made based on the sensors 21 still detecting a change in magnetic field M strength local thereto.

As depicted in FIG. 1B, which is a schematic of a bottom hole assembly (BHA) 40 comprising a wellbore magnet tool 10 of this disclosure, a BHA 40 can comprise one or more tools 30A uphole from wellbore magnet 10 and/or one or more wellbore tools 30B downhole from wellbore magnet tool 10. That is, first end 22A of wellbore magnet tool 10 can be connected with and/or proximal an uphole wellbore tool 30A and second end 22B of wellbore magnet tool 10 can be connected with and/or proximal a downhole wellbore tool 30B. The uphole wellbore tool 30A, the downhole wellbore tool 30B can be selected from any number of wellbore tools. For example, in embodiments, uphole wellbore tool 30A, downhole wellbore tool 30B, or both can comprise another wellbore magnet tool, such as another wellbore magnet tool 10 according to this disclosure, or a disparate wellbore magnet tool, a measuring while drilling/logging while drilling (MWD/LWD) tool, or a combination thereof. The electronics board 24 and/or the MWD/LWD tool (e.g., of uphole wellbore tool 30A and/or downhole wellbore tool 30B) can further comprise a battery for powering the plurality of sensors 21.

Sensors 21 can thus be connected by a basic hollow cylinder chassis 20 that contains necessary wires to connect the plurality of sensors 21 (e.g., first sensor 21A, second sensor 21, or both) to processing board 24 that may contain a battery. In embodiments, the plurality of sensors 21 can be powered by an uphole or downhole MWD tool (e.g., of uphole wellbore tool 30A and/or downhole wellbore tool 30B). The wellbore magnet tool 10 can thus, in embodiments, be connected to other magnets/magnet tools (of this disclosure or conventional magnets/magnet tools) or MWD/LWD tools via appropriate connectors. Connectors can be length adjustable to allow for thread recuts in the main body.

Although described hereinabove with the first sensor 21A and the second sensor 21B on a same outer circumference of a single magnet tool 10, it is also envisioned that, in embodiments a first sensor 21A is positioned proximal one or more of the plurality of magnets 15 in a first magnet tool 10; and a second sensor 21B can be positioned on another magnet tool (e.g., when 30A and/or 30B is a magnet tool 10). That is, in embodiments, only one sensor 21 (e.g., 21A and/or 21B) can be associated with a magnet tool 10, and multiple magnet tools can be employed, for example when uphole wellbore 30A and/or downhole wellbore tool 30B also comprises a wellbore magnet tool 10. In such embodiments, downhole data can be compared from magnet to magnet instead of uphole and downhole within the same magnet or tool. For example, in embodiments, a plurality (e.g., four) (e.g., shorter) magnet tools 10 of a tool string can each comprise a single sensor 21A/21B, rather than utilizing two sensors 21A/21B per magnet tool in (e.g., a longer) magnet tool 10, as depicted in FIG. 1A. Alternatively, in such a configuration comprising multiple magnet tools 10, sensors 21 in the middle magnet tools 10 (e.g., in the middle two magnet tools 10, in the four magnet tool 10 embodiment mentioned above) and only (e.g., 2) magnet tools 10 that are lower (e.g., lowest) and higher (e.g., highest) in the string can comprise a single sensor 21 (e.g., 21A/21B). Accordingly, in embodiments, a magnet tool assembly of this disclosure comprises one or a plurality of magnet tools 10, and a plurality of sensors, wherein each of the one or the plurality of magnet tools 10 comprises one or more of the plurality of sensors. Thus, sensors can be located within one of the one or the plurality of magnet tools 10 or a plurality of the magnet tools 10. With reference to FIG. 1, in embodiments, wellbore tool 30A and wellbore tool 30B can each comprise a magnet tool 10 comprising a single sensor 21 (e.g., wellbore tool 30A is a magnet tool 10 of this disclosure comprising a single sensor 21A and wellbore tool 30B is a magnet tool 10 of this disclosure comprising a single sensor 21B), and, rather than being a magnet tool 10 of this disclosure, a central tool in the tool string can be a wellbore tool 30A/30B (e.g., a conventional magnet that does not comprise a sensor 21).

Figure 2C:
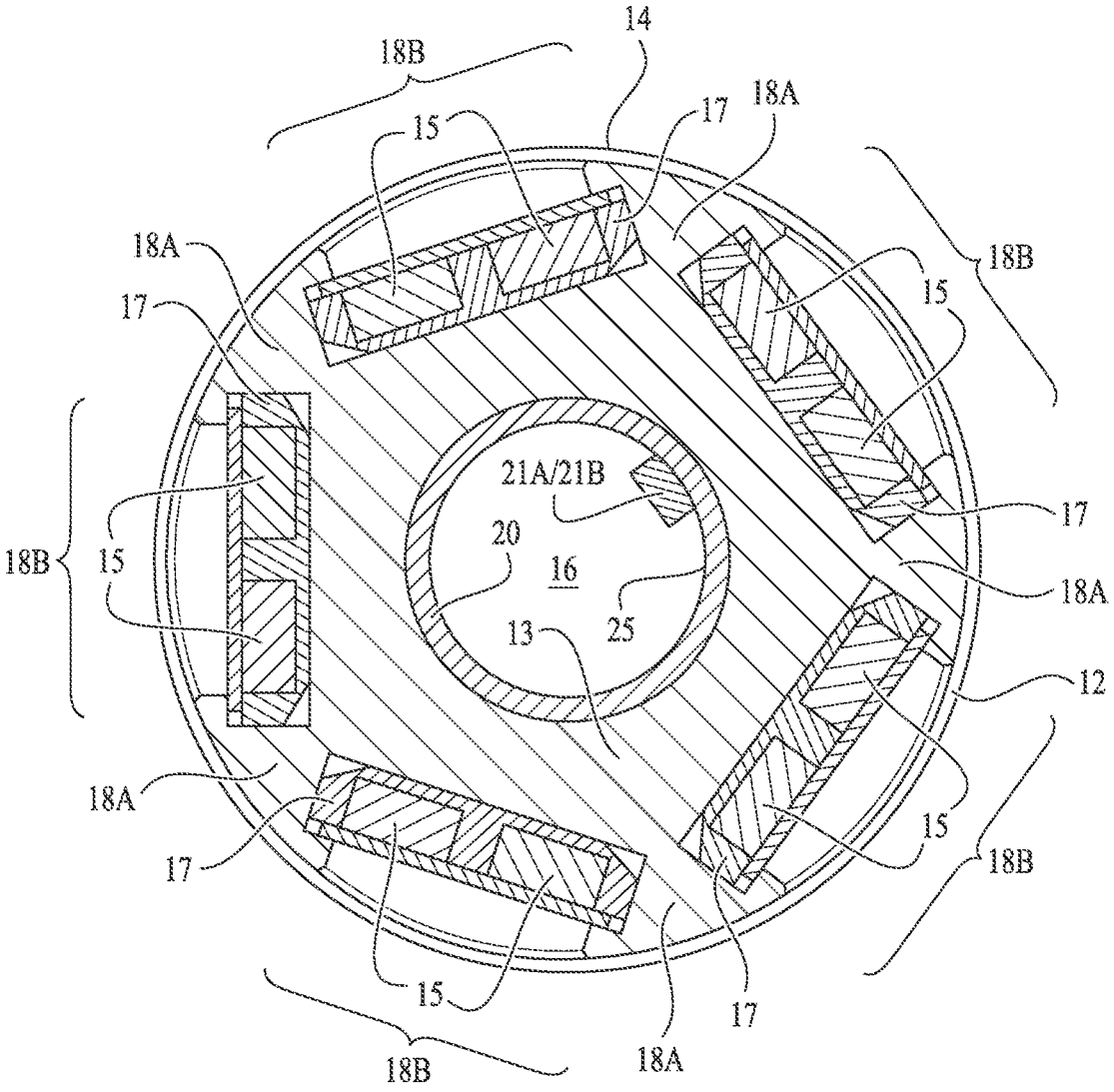
FIG. 2C is a schematic illustration of a cross section of another wellbore magnet tool, according to other embodiments of this disclosure.
Figure 3A:
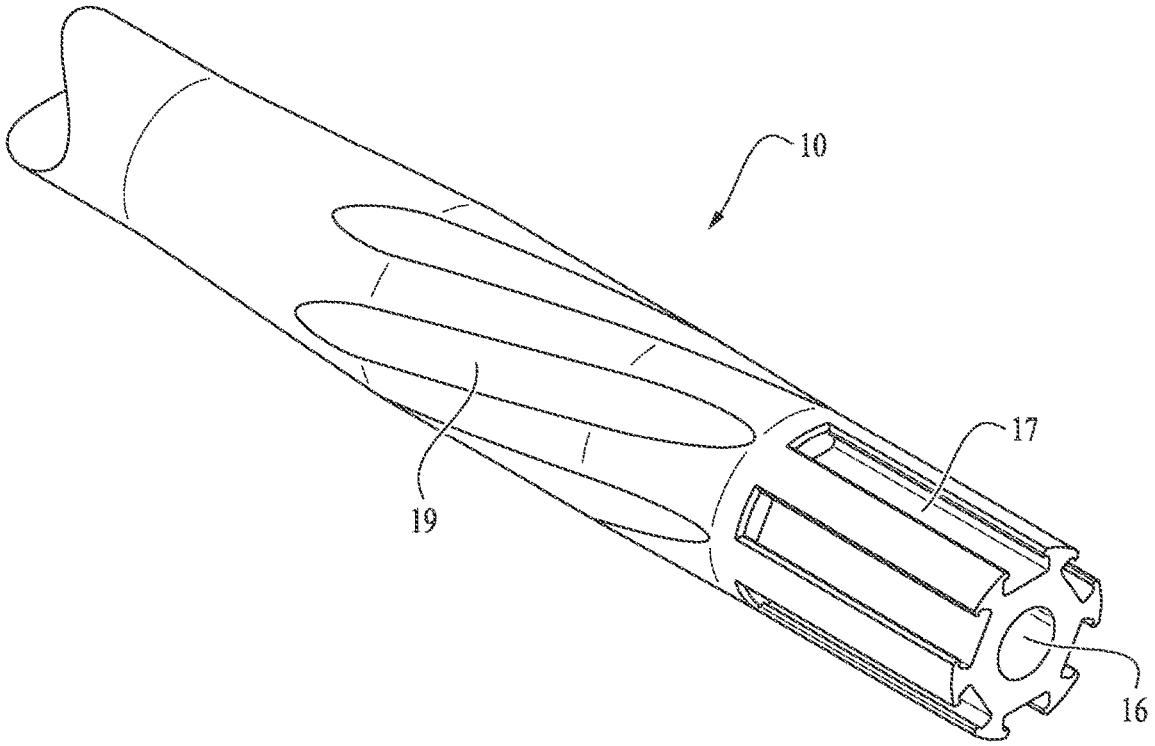
FIG. 3A is a schematic perspective view of a wellbore magnet tool, showing in call out non-magnetic and magnetic areas about the outer circumference of the wellbore magnet tool.
Figure 3B:
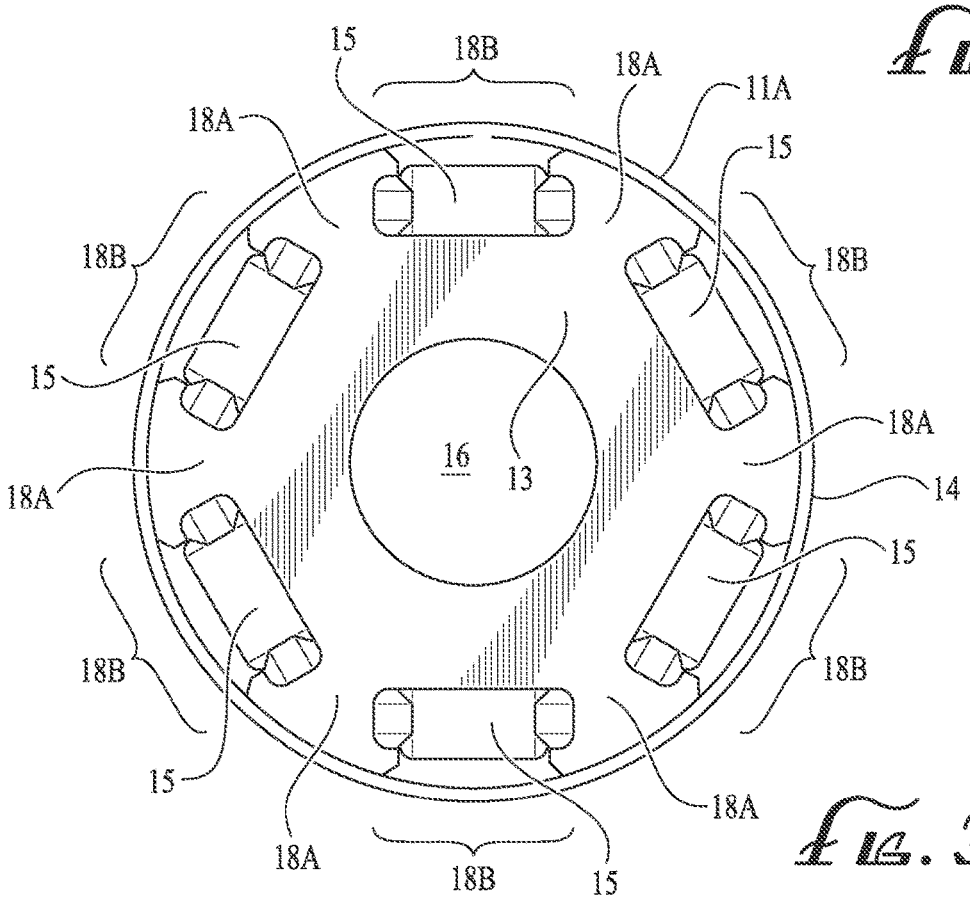
FIG. 3B is a schematic cross section view of the wellbore magnet tool of FIG. 3A.

As depicted in FIG. 2A, the plurality of magnets 15 can be housed in magnet carriers 17 distributed about an outer circumference 14 of the wellbore magnet tool 10, in cylindrical walls 13 thereof. The plurality of sensors 21 (e.g., the first sensor 21A, the second sensor 21B, or both) can be positioned within a cylindrical wall 13 of the wellbore magnet tool 10, proximal one or more of the plurality of magnets 15. The plurality of sensors 21 (e.g., the first sensor 21A, the second sensor 21B, or both) can include one or more sensors 21 placed at the bottom (e.g., second or downhole end 22B) and the top (e.g., first or uphole end 22A) of the wellbore magnet tool 10. The sensors 21 can extend from the inside diameter (e.g., from inside surface 11B of cylindrical wall 13 of the wellbore magnet tool 10 to a position close/proximal to the magnets 15 or can be placed on the inside diameter (e.g., on inside surface 25 of chassis 20 or inside surface 11B of cylindrical wall 13 of wellbore magnet tool 10) of the wellbore magnet tool 10. For example, as depicted in the schematic of FIG. 2B, each of the plurality of sensors 21 (e.g., first sensor 21A, second sensor 21B, or both) can be positioned within the body/wall 13 of wellbore magnet tool 10, proximal one or more of the magnets 15 of the plurality of magnets. The sensors 21 can be electronically connected to the electronics board 24 and/or chassis 20. As depicted in the schematic of FIG. 2C, and noted hereinabove, alternatively or additionally, one or more of the plurality of sensors 21 (e.g., first sensor 21A, second sensor 21B, or both) and/or electronics board 24 can be positioned within the interior flow bore 16 of wellbore magnet tool 10, and attached to interior surface 25 of chassis 20.

As best seen in FIG. 2A, FIG. 2B, and FIGS. 3A and 3B, which are schematics of a wellbore magnet tool, showing in call out magnetic areas 18A and non-magnetic 18B about the outer circumference 14 of the wellbore magnet tool 10, in embodiments, the plurality of magnets 15 can be distributed about the outer circumference 14 of the wellbore magnet tool 10 in a plurality of magnetic areas 18B, each magnetic area 18B of the plurality of magnetic areas 18B comprising one or more of the plurality of magnets 15, such that a plurality of non-magnetic areas 18A are provided, with one of the non-magnetic areas 18B distributed about the outer circumference 14 of the wellbore magnet tool 10 between each pair of the magnetic areas 18B of the plurality of magnetic areas 18B. Alternatively, when an amount of debris 36 expected to be encountered by the wellbore magnet tool 10 is low, no non-magnetic areas 18B may be present, and substantially the entirety of the outer circumference 14 of the wellbore magnet tool 10 can comprise magnetic area 18B.

The plurality of magnets 15 can comprise any suitable magnets. For example, in embodiments, the plurality of magnets 15 comprise rare earth magnets (e.g., neodymium bar magnets).

The changes in the magnetic field M detected by the plurality of sensors 21 (e.g., by the first sensor 21A, the second sensor 21B, or both) can be utilized to determine, substantially in real time, if a debris 36 collection capacity of the wellbore magnet tool 10 has been reached or exceeded. For example, prior to collection of any debris by the wellbore magnet tool 10, a magnetic field M proximal the first sensor 21A can be sensed by the first sensor 21A and the magnetic field M proximal the second sensor 21B can be sensed by second sensor 21B. Upon debris collection, the magnetic field M sensed by the second (downhole) sensor 21B may begin to change (e.g., decrease in strength) relative to the initial magnetic field sensed thereby and/or relative to the magnetic field being sensed by the first (e.g., uphole) sensor 21A. After some collection time, the magnetic field sensed by the second sensor 21B may stop changing, while the magnetic field sensed with the first sensor 21A may begin to change (e.g., to decrease in strength). When the magnetic field sensed by the first sensor 21B stops changing and/or equals the now unchanging magnetic field sensed by the second sensor, a debris collection capacity of the wellbore magnet tool 10 can be considered spent, or to have reached its maximum debris collection capacity. At this point, if all magnet tools in the wellbore are at maximum debris collection capacity, other measures can be taken, as needed. For example, when the debris collection capacity of the wellbore magnet tool 10 (or of all the wellbore magnet tools downhole) has (have) reached maximum debris collection capacity, another operation can be utilized, such as, for example, pumping a high viscosity (hi-vis) pill downhole, increasing a flow rate, activating a circulation sub (e.g., of uphole wellbore tool or component 30A or downhole wellbore tool or component 30B) of the BHA 40, or a combination thereof.

The plurality of sensors 21 (e.g., the first sensor 21A, the second sensor 21B, or both) can, in embodiments, directly detect Gauss readings or comprise magnetometers. A variety of sensors can be utilized to detect changes in the local magnetic fields M. There are several types of instruments or sensors 21 that can be used to measure the strength of magnetic field M produced by an arrangement of magnets 15. For example, in embodiments, the plurality of sensors 21 (e.g., first sensor 21A, second sensor 21B, or both) comprise Hall effect sensors. Hall effect sensors measure the strength of a magnetic field by detecting changes in voltage across a thin strip of conducting material when exposed to a magnetic field. Hall effect sensors can measure the strength of the local magnetic field by detecting the voltage generated by the Hall effect. Hall effect sensors can be utilized to measure both DC and AC magnetic fields. Hall effect sensors that work on the principle of the Hall Effect can produce a voltage in a conductor when a magnetic field is applied perpendicular to the direction of current flow. Hall-effect sensors can be used to measure magnetic field strength or to detect the presence of a magnetic field. By placing a Hall-effect sensor in the magnetic field, it can generate a voltage proportional to the field strength. This voltage can be measured using a voltmeter or an analog-to-digital converter (ADC) and then converted to magnetic field strength, for example, by using a calibration factor.

In embodiments, the plurality of sensors 21 (e.g., first sensor 21A, second sensor 21B, or both) comprise fluxgate magnetometers. Fluxgate magnetometers can utilize a coil of wire to measure changes in magnetic flux, which can be used to calculate the strength of the magnetic field proximal the sensors. These sensors can employ a core made of a magnetic material, which is driven into saturation by a driving current. A secondary coil can be wound around the core, and the induced voltage can be measured. The output signal is proportional to the strength of the magnetic field. A fluxgate magnetometer is thus a sensitive device that measures the strength and direction of a magnetic field by detecting the changes in magnetic flux through a ferromagnetic core. Fluxgate magnetometers typically utilize two coils wound around a core, one for driving the core into saturation and the other for detecting the induced magnetic field. Fluxgate magnetometers can measure both static and low-frequency magnetic fields. Fluxgate magnetometers can measure the magnetic field strength by detecting the changes in magnetic flux through a ferromagnetic core. By analyzing the output signal from the fluxgate magnetometer, the magnetic field strength can be calculated.

In embodiments, the plurality of sensors 21 (e.g., first sensor 21A, second sensor 21B, or both) comprise coil-based magnetometers. Coil-based magnetometers can measure magnetic fields by detecting the EMF induced in a coil due to the presence of a magnetic field. The output voltage is proportional to the magnetic field strength. Examples include search coil magnetometers and proton precession magnetometers. Devices like search coil magnetometers and proton precession magnetometers can measure magnetic fields by detecting the EMF induced in a coil due to the presence of a magnetic field. By processing the output signal, the magnetic field strength can be determined.

In embodiments, the plurality of sensors 21 (e.g., first sensor 21A, second sensor 21B, or both) comprise magnetoresistive sensors. These sensors work on the principle of magnetoresistance, which is the change in electrical resistance of a material when a magnetic field is applied. There are several types of magnetoresistive sensors: Anisotropic Magnetoresistance (AMR) sensors, Giant Magnetoresistance (GMR) sensors, and tunneling magnetoresistive (TMR) sensors. Magnetoresistive sensors can detect changes in the electrical resistance of a material when exposed to a magnetic field, which can be utilized to determine the strength of the magnetic field proximal the sensor or for detecting the presence of a magnetic field. Anisotropic Magnetoresistive (AMR) sensors can exhibit a change in resistance when subjected to a magnetic field, which depends on the angle between the current direction and the magnetic field. Giant Magnetoresistive (GMR) sensors can utilize thin ferromagnetic layers separated by a non-magnetic layer, leading to a significant change in resistance in response to a magnetic field. Tunneling Magnetoresistive (TMR) sensors can be based on the quantum mechanical tunneling effect, where the resistance of a thin insulating layer between two ferromagnetic layers changes in response to an applied magnetic field. Magnetorestrictive sensors can measure magnetic fields by detecting the change in dimensions of a magnetostrictive material in response to a magnetic field. The change in dimensions is proportional to the magnetic field strength. Similar to Hall-effect sensors, magnetoresistive sensors can change their electrical resistance when exposed to a magnetic field. By measuring the change in resistance using a Wheatstone bridge circuit, an ADC, or other electronic circuitry, the magnetic field strength can be determined.

In embodiments, the plurality of sensors 21 (e.g., first sensor 21A, second sensor 21B, or both) comprise SQUIDs (Superconducting Quantum Interference Devices), that operate based on the principles of superconductivity and quantum mechanics. SQUIDs are extremely sensitive sensors that employ superconducting materials to measure extremely small changes in magnetic flux, allowing them to detect even very weak magnetic fields. By processing the output signal from a SQUID, the magnetic field strength can be determined with high accuracy.

In embodiments, the plurality of sensors 21 (e.g., first sensor 21A, second sensor 21B, or both) comprise magnetic field meters. Magnetic field meters can use a variety of techniques to measure the strength of a magnetic field, including, without limitation, induction, magnetoresistance, and the Hall Effect.

In embodiments, the plurality of sensors 21 (e.g., first sensor 21A, second sensor 21B, or both) comprise Gaussmeters (or Teslameters). Gaussmeters can measure the strength of a magnetic field in units of Gauss (or Tesla), which is a unit of magnetic flux density. Such meters comprise a magnetic field probe or sensor (such as a Hall probe or magnetoresistive sensor) connected to an electronic meter. The probe senses the magnetic field, and the meter converts the signal into a readable output. A Gaussmeter (Teslameter) can measure magnetic field strength directly by using a probe or sensor that detects the magnetic field, such as a Hall probe or a magnetoresistive sensor. The probe can be placed in the magnetic field M, and the meter converts the detected signal into a readable output in units of Gauss or Tesla.

In embodiments, the plurality of sensors 21 (e.g., first sensor 21A, second sensor 21B, or both) comprise Magneto-Optical Sensors. Magneto-optical sensors can measure the polarization of light that has been affected by a magnetic field. Magneto-optical sensors are highly sensitive and can detect very small magnetic fields.

In embodiments, the plurality of sensors 21 (e.g., first sensor 21A, second sensor 21B, or both) comprise optically pumped magnetometers, which can measure magnetic fields by detecting the change in energy levels of atoms or molecules when subjected to a magnetic field. Examples include alkali-vapor magnetometers, helium magnetometers, and spin-exchange relaxation-free (SERF) magnetometers. By analyzing the change in energy levels of atoms or molecules when subjected to a magnetic field, these magnetometers can determine the magnetic field strength.

In embodiments, the plurality of sensors 21 (e.g., first sensor 21A, second sensor 21B, or both) comprise magnetodiodes or magnetotransistors, which are semiconductor devices that can change their electrical properties, such as current-voltage characteristics, in response to an applied magnetic field. They can be used for detecting magnetic fields and measuring field strength.

In embodiments, the plurality of sensors 21 (e.g., first sensor 21A, second sensor 21B, or both) comprise inductive sensors, which can measure changes in magnetic fields by detecting the induced electromotive force (EMF) in a coil or wire. The induced EMF is proportional to the rate of change of the magnetic field. By integrating the induced EMF over time, the magnetic field strength can be calculated.

Overall, the choice of instrument or sensors 21 for measuring the strength of magnetic force produced by an arrangement of magnets 15 can depend on the specific application and the required level of range, sensitivity and accuracy, and the environmental conditions in which the sensor 21 will be used. Sensors 21 can comprise one or a combination of the above-mentioned types of sensors, or other suitable sensor types, to measure the strength of magnetic force produced by the arrangement of the plurality of magnets 15.

Figure 4A:
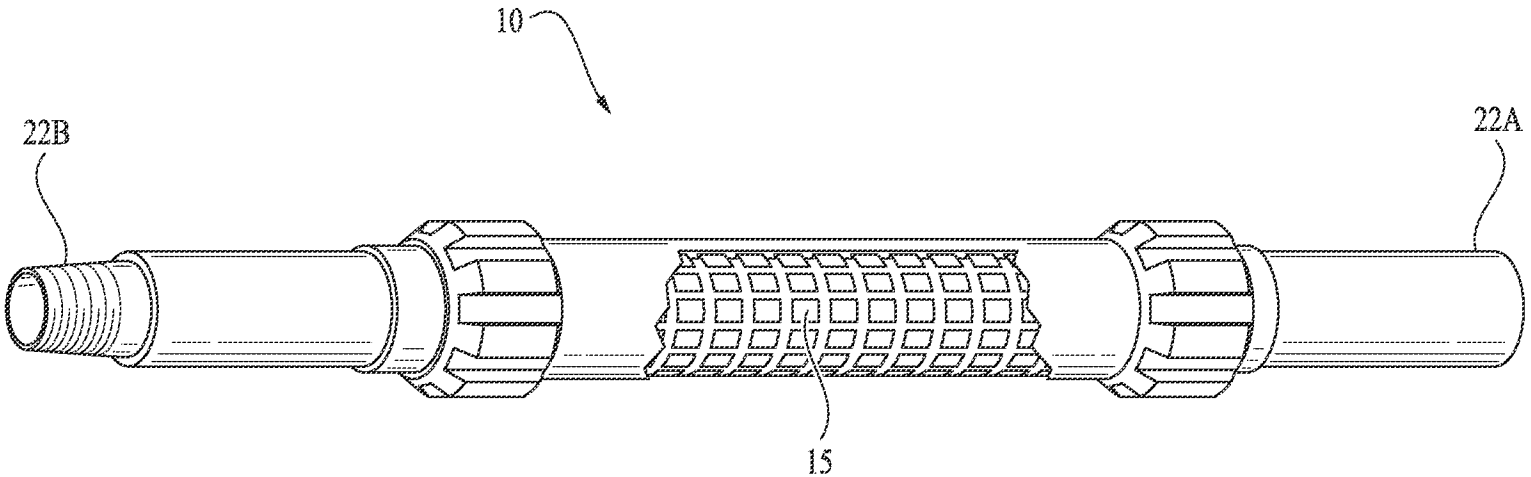
FIG. 4A depicts an external view of an illustrative wellbore magnet tool, according to embodiments of this disclosure.
Figure 4B:
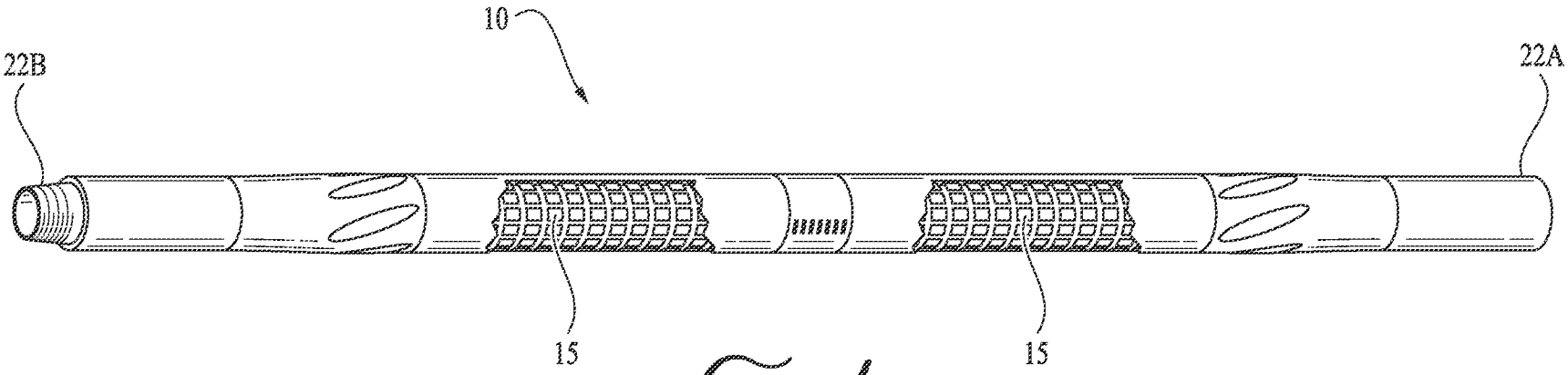
FIG. 4B depicts an external view of another illustrative wellbore magnet tool, according to embodiments of this disclosure.
Figure 4C:
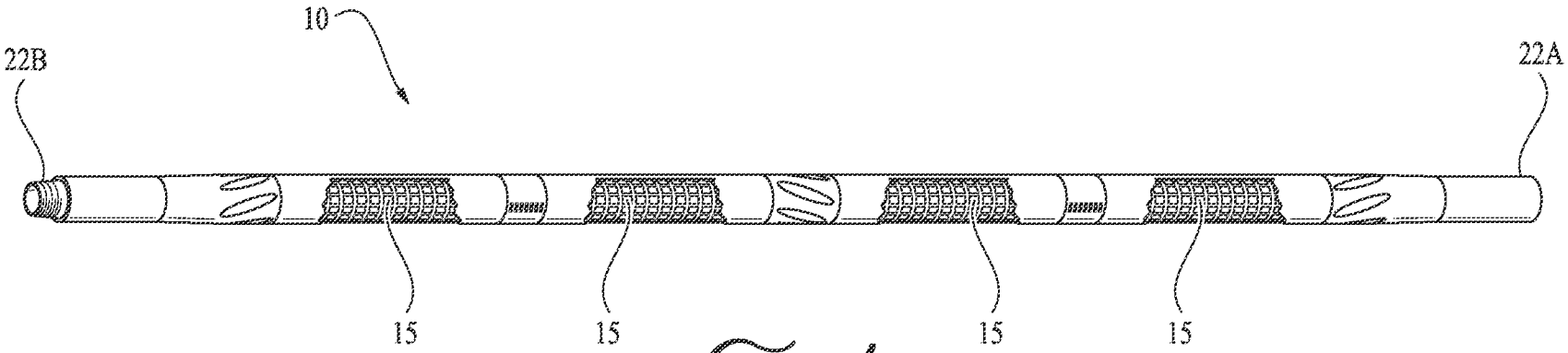
FIG. 4C depicts an external view of another illustrative wellbore magnet tool, according to embodiments of this disclosure.

FIG. 4A, FIG. 4B, and FIG. 4C depict external views of illustrative wellbore magnet tools 10, according to embodiments of this disclosure. A variety of wellbore magnets can be designed and/or retrofitted with the plurality of sensors 21 and electronics board 24 integrated therein, as described herein. Accordingly, the wellbore magnet tool 10 is not limited to the exemplary structures depicted in FIG. 4A to FIG. 4C. The wellbore magnet tool 10 can comprise a variety of arrangements of magnets 15 about an outer circumference 14 thereof, with the plurality of magnets 15 extending various lengths and spacings along the length of the wellbore magnet tool 10 from the first end 22A to the second end 22B thereof. By way of example, in embodiments, the wellbore magnet tool 10 comprises a CLEANWELL® Magnet, such as, for example, a CLEANWELL® POWERMAG®, POWERMAG® II, MAGTECH® VALI TECH®, VOR TECH®, VAC TECH®, or VAC TECH® II, available from Halliburton Energy Services, and adapted as described herein to include the plurality of sensors 21 and electronics board 24 (optionally inserted in a flow bore 16 thereof via a chassis 20, as described herein) to enable monitoring (e.g., substantially real time) of the remaining debris 36 collection capacity of the wellbore magnet tool 10.

In embodiments, the debris collection capacity of the wellbore magnet tool 10 is from about 50 to about 300 pounds (lb) (from about 23 to about 136 kilograms (kg)), from about 80 to about 300 lb (from about 36 to about 136 kg), from about 100 to about 300 lb (from about 45 to about 136 kg), or from about 150 to about 250 lb (from about 68 to about 113 kg) debris 36. In embodiments, the debris collection capacity of the wellbore magnet tool 10 is greater than or equal to about 50, 60, 70, 80, 90, 100, 150, 200, or 250 lb (greater than or equal to about 23, 27, 32, 36, 41, 45, 68, 91, or 113 kg) of debris 36, or more. In embodiments, the wellbore magnet tool 10 has an outer diameter D in a range of from about 5 to about 10 inches (from about 12 to about 25 cm), from about 6 to about 10 inches (from about 15 to about 25 cm), or from about 7 to about 9 inches (from about 18 to about 23 cm). In embodiments, the wellbore magnet tool 10 has an outer diameter D of greater than or equal to about 5, 6, 7, 8, 9, or 10 inches (greater than or equal to about 12, 15, 18, 20, 23, or 25 cm); in embodiments, the wellbore magnet tool 10 has an outer diameter D of less than or equal to about 10, 9, 8, 7, 6, or 5 inches (less than or equal to about 25, 23, 20, 18, 15, or 12 cm); or a combination thereof.

Also disclosed herein is a method comprising: positioning a wellbore magnet tool 10 as described herein downhole in a wellbore 35; collecting debris 36 with the wellbore magnet tool 10; and monitoring a debris 36 collection capacity of the wellbore magnet tool 10 during the collecting of the debris 36, substantially in real time, by monitoring changes in the magnetic field M detected by the plurality of sensors 21 (e.g., by the first sensor 21A, the second sensor 21B, or both).

In embodiments, the electronics board 24 of the wellbore magnet tool 10 can be electronically connected to a surface 37 via wired drill pipe (WDP) 38, and/or via measuring while drilling/logging while drilling (MWD/LWD) tool (e.g., of uphole wellbore tool 30A or downhole wellbore tool 30B) and a surface acquisition system 39, whereby data from the plurality of sensors 21 can be transmitted to (a device at or above) the surface 37 (e.g., data acquisition system 39), and/or information/instructions can be sent from the surface 37 to the wellbore magnet tool 10. In embodiments, the data from the plurality of sensors 21 (e.g., from first sensor 21A, second sensor 21B, or both) can be transmitted to the surface via mud pulse telemetry.

The method can further comprise estimating the debris collection capacity remaining to the wellbore magnet tool 10 by comparing the change in the local magnetic field M detected by the first sensor 21A, the change in the local magnetic field M detected by the second sensor 21B, and/or the change in the local magnetic field M detected by the second sensor 21B relative to the change in the local magnetic field M detected by the first sensor 21A. An unchanging magnetic field may indicate that debris collection capacity local to that sensor 21 has reached maximum debris 36 collection capacity.

In embodiments, as noted hereinabove with reference to FIG. 1B, the wellbore magnet tool 10 is positioned downhole in the wellbore 35 in conjunction with a bottom hole assembly (BHA) 40. In such embodiments, the method can further comprise, upon a determination that the debris collection capacity of the wellbore magnet tool 10 (or of all wellbore magnet tools in the wellbore) has been reached or exceeded, performing another operation. For example, when the debris 36 collection capacity of the wellbore magnet tool 10 (and/or of all wellbore magnet tools in the wellbore) has been reached another operation can be performed. The another operation can be, for example, selected from, for example, injecting a high viscosity (hi-vis) pill downhole, increasing a flow rate of a fluid circulated downhole, activating a circulation sub of the BHA 40, or a combination thereof. The use of an "intelligent" magnet such as wellbore magnet tool 10 thus allows for contingency operations when the tools 10/BHA 40 are still downhole, which can provide for significant operational improvement, and fewer trips downhole. In embodiments, the another operation can be performed without removing the wellbore magnet tool 10 (or the BHA 40) from the wellbore 35, and thus potentially saving a cleanout run/trip.

In embodiments, the method can further comprise forming at least a portion of the debris 36 by performing a milling operation. The milling operation can comprise, for example, a deburr milling operation, which may be performed subsequent a wellbore perforations operation to deburr the perforations formed during the perforations operation. Alternatively, the milling operation can comprise a window milling operation in which a window is milled in a casing.

Also disclosed herein is a method of collecting debris with a wellbore magnet tool 10 of this disclosure. The method can comprise removably inserting a chassis 20 into a flow bore 16 of a wellbore magnet tool 10, wherein the wellbore magnet tool 10 comprises a plurality of magnets 15 positioned about an outer circumference 14 of the wellbore magnet tool 10, wherein the chassis 20 is substantially cylindrical, and wherein the chassis 20 comprises a plurality of sensors 21 and an electronics (processing) board 24 positioned on an inside surface 25 of the chassis 20, wherein the plurality of sensors 21 include: a first sensor 21A proximal one or more of the plurality of magnets 15; and a second sensor 21B positioned downhole from the first sensor 21A and proximal one or more other of the plurality magnets 15, and wherein the first sensor 21A and the second sensor 21B detect changes in a magnetic field M proximate (e.g., local) thereto, which changes result from debris 36 collection by the wellbore magnet tool 10. The method can further comprise positioning the wellbore magnet tool 10 downhole in a wellbore 35 in conjunction with a bottom hole assembly (BHA) 40 utilized during a milling operation (or another operation that forms the debris 36 collected by the wellbore magnet tool 10); collecting debris 36 with the wellbore magnet tool 10 during and/or subsequent the milling operation (or the another operation that forms the debris 36 collected by the wellbore magnet tool 10), wherein at least a portion of the debris 36 is produced by the milling operation (or the another operation that forms the debris 36 collected by the wellbore magnet tool 10); and monitoring a debris 36 collection capacity of the wellbore magnet tool 10 during the collecting of the debris 36 with the wellbore magnet tool 10, substantially in real time, by monitoring changes in the local magnetic fields M detected by the plurality of sensors 21. The method can further comprise removing the wellbore magnet tool 10 from the wellbore 35, removing the chassis 20 from the wellbore magnet tool 10, and optionally inserting the chassis 20 into the flow bore 16 of another wellbore magnet tool 10.

In general, conventional magnet tools are very simple and provide no way to monitor or estimate how much debris they have captured or how close to capacity they are until they have been taken back to surface, observed, cleaned, and the debris weighed. The wellbore magnet tool 10 of this disclosure provides for estimating, substantially in real time, an amount of debris 36 that has been captured by the plurality of magnets 15 of the wellbore magnet tool 10, and determining when a debris 36 collection capacity of the wellbore magnet tool 10 has been or may be reached (e.g., when the wellbore magnet tool is and/or will become fully loaded with captured debris 36 and can capture no more debris 36).

The herein disclosed wellbore magnet tool 10 and methods of using same enable the real time monitoring of the performance of the wellbore magnet tool 10. Knowing that magnets 15 of the wellbore magnet tool(s) are still performing well and are not at capacity can reduce unnecessary additional cleanout trips, and thus save significant time and expense (e.g., rug time and savings) for the customer.

Generally, when running clean up BHAs 40 and in particular in multilateral applications, there can be a minimum debris 36 recovery required in order to proceed ahead with the completion of the well. If the debris 36 recovery at the wellbore magnet tool(s) 10 is known "real-time" and is not sufficient, other operations, as noted herein, may be performed prior to pulling out of hole with the BHA 40.

Data taken from runs with the wellbore magnet tool(s) 10 of this disclosure can be utilized to optimize/more closely estimate a number of magnet tools needed in the string, rather than putting as many magnet tools as possible downhole and hoping it is enough to capture all the debris 36 that is downhole or is being generated (e.g., during milling, such as window milling).

In embodiments, a wellbore magnet tool(s) 10 of this disclosure is utilized during wellbore completions. The herein disclosed wellbore magnet tool 10 can enable collection of swarf (e.g., window cuttings) before they reach the surface 37.

ADDITIONAL DISCLOSURE

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. The following are non-limiting, specific embodiments in accordance with the present disclosure:

In a first embodiment, a wellbore magnet tool comprises: a plurality of magnets (e.g., positioned about an outer circumference of the wellbore magnet tool); a plurality of sensors, including: a first sensor proximal one or more of the plurality of magnets; and a second sensor positioned downhole from the first sensor (e.g., and proximal one or more other of the plurality magnets); and an electronics (e.g., processing) board; wherein the first sensor and the second sensor are electronically connected with the electronics board, and wherein the first sensor and the second sensor detect changes in a magnetic field proximate thereto, which changes result from debris collection by the wellbore magnet tool.

A second embodiment can include the wellbore magnet tool of the first embodiment, further comprising a chassis, wherein the chassis is substantially cylindrical, and is positioned within an interior flow bore of the wellbore magnet tool, and wherein the first sensor, the second sensor, and/or the electronics board are connected to the chassis.

A third embodiment can include the wellbore magnet tool of the second embodiment, wherein the first sensor, the second sensor, or both are positioned on an inside surface of the chassis.

A fourth embodiment can include the wellbore magnet tool of the second or third embodiment, wherein the first sensor, the second sensor, or both are positioned within a cylindrical wall of the wellbore magnet tool, proximal one or more of the plurality of magnets.

A fifth embodiment can include the wellbore magnet tool of any of the second to fourth embodiments, wherein the chassis is removably positioned in the interior flow bore of the wellbore magnet tool.

A sixth embodiment can include the wellbore magnet tool of any of the first to fifth embodiments, wherein the plurality of magnets are distributed about the outer circumference of the wellbore magnet tool in a plurality of magnetic areas, each magnetic area of the plurality of magnetic areas comprising one or more of the plurality of magnets, such that a plurality of non-magnetic areas are provided, with one of the non-magnetic areas distributed about the outer circumference of the wellbore magnet tool between each pair of the magnetic areas of the plurality of magnetic areas.

A seventh embodiment can include the wellbore magnet tool of any of the first to sixth embodiments, wherein the first sensor is positioned proximal a first (e.g., uphole, box) end of the wellbore magnet tool and the second sensor is positioned proximal a second (e.g., downhole, pin) end of the wellbore magnet tool.

An eighth embodiment can include the wellbore magnet tool of any of the first to seventh embodiments, wherein the plurality of sensors comprises one or more additional sensors in addition to the first sensor and the second sensor, wherein the one or more additional sensors are electronically connected with the electronics board, and wherein the one or more additional sensors are configured to detect changes in a magnetic field proximate thereto, which changes result from debris collection by the wellbore magnet tool.

A ninth embodiment can include the wellbore magnet tool of any of the first to eighth embodiments, wherein the first sensor, the second sensor, or both directly detect Gauss readings or comprise magnetometers.

A tenth embodiment can include the wellbore magnet tool of any of the first to ninth embodiments, wherein the changes in the magnetic field detected by the first sensor, the second sensor, or both can be utilized to determine, substantially in real time, if a debris collection capacity of the wellbore magnet tool has been reached or exceeded.

An eleventh embodiment can include the wellbore magnet tool of any of the first to tenth embodiments, wherein the plurality of magnets comprise rare earth (e.g., neodymium) bar magnets.

In a twelfth embodiment, a method comprises: positioning a wellbore magnet tool of any of the first to eleventh embodiments downhole in a wellbore; collecting debris with the wellbore magnet tool; and monitoring a debris collection capacity of the wellbore magnet tool during the collecting of the debris, substantially in real time, by monitoring changes in the local magnetic field detected by the first sensor, the second sensor, or both.

A thirteenth embodiment can include the method of the twelfth embodiment, wherein the electronics board of the wellbore magnet tool is electronically connected to a surface via wired drill pipe (WDP), and/or via measuring while drilling/logging while drilling (MWD/LWD) tool and a surface acquisition system, whereby data from the plurality of sensors is transmitted to the surface.

A fourteenth embodiment can include the method of the thirteenth embodiment, wherein the data is transmitted to the surface via mud pulse telemetry.

A fifteenth embodiment can include the method of the thirteenth or fourteenth embodiment, wherein the electronics board and/or the MWD/LWD tool further comprises a battery.

A sixteenth embodiment can include the method of any of the twelfth to fifteenth embodiments, further comprising estimating the debris collection capacity based on the change in the local magnetic field detected by the first sensor, the change in the local magnetic field detected by the second sensor, or the change in the local magnetic field detected by the second sensor relative to the change in the local magnetic field detected by the first sensor.

A seventeenth embodiment can include the method of any of the twelfth to sixteenth embodiments, wherein the wellbore magnet tool of claim 1 is positioned downhole in the wellbore in conjunction with a bottom hole assembly (BHA), and wherein the method further comprises, upon a determination that the debris collection capacity has been reached or exceeded, performing another operation, wherein the another operation comprises pumping a high viscosity (hi-vis) pill downhole, increasing a flow rate, activating a circulation sub of the BHA, or a combination thereof.

An eighteenth embodiment can include the method of the seventeenth embodiment, wherein the another operation is performed without removing the wellbore magnet tool (and/or the BHA) from the wellbore.

A nineteenth embodiment can include the method of any of the twelfth to eighteenth embodiments, further comprising forming at least a portion of the debris by performing a milling operation.

A twentieth embodiment can include the method of the nineteenth embodiment, wherein the milling operation comprises a deburr milling operation (e.g., a deburr milling operation performed subsequent a wellbore perforations operation to deburr the perforations formed) and/or a window milling operation.

In a twenty first embodiment, a method comprises removably inserting a chassis into a flow bore of a wellbore magnet tool, wherein the wellbore magnet tool comprises a plurality of magnets positioned about an outer circumference of the wellbore magnet tool, wherein the chassis is substantially cylindrical, and wherein the chassis comprises a plurality of sensors and an electronics (e.g., processing) board positioned on an inside surface of the chassis, wherein the plurality of sensors include: at least a first sensor proximal one or more of the plurality of magnets; and a second sensor positioned downhole from the first sensor and proximal one or more other of the plurality magnets, and wherein the first sensor and the second sensor detect changes in a magnetic field proximate thereto, which changes result from debris collection by the wellbore magnet tool; positioning the wellbore magnet tool downhole in a wellbore in conjunction with a bottom hole assembly (BHA) utilized during a milling operation; collecting debris with the wellbore magnet tool during and/or subsequent the milling operation, wherein at least a portion of the debris is produced by the milling operation; and monitoring a debris collection capacity of the wellbore magnet tool during the collecting of the debris with the wellbore magnet tool, substantially in real time, by monitoring changes in the magnetic fields detected by the plurality of sensors.

A twenty second embodiment can include the method of the twenty first embodiment, further comprising removing the wellbore magnet tool from the wellbore, removing the chassis from the wellbore magnet tool, and optionally inserting the chassis into another wellbore magnet tool.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=R1+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A wellbore magnet tool comprising:

a plurality of magnets positioned about an outer circumference of the wellbore magnet tool;

a plurality of sensors, including: a first sensor proximal one or more of the plurality of magnets; and a second sensor positioned downhole from the first sensor and proximal one or more other of the plurality magnets; and an electronics board;

wherein the first sensor and the second sensor are electronically connected with the electronics board, wherein the first sensor and the second sensor detect changes in a magnetic field proximate thereto, which changes result from debris collection by the wellbore magnet tool, and wherein the first sensor, the second sensor, or both are positioned within a cylindrical wall of the wellbore magnet tool, proximal one or more of the plurality of magnets.

2. The wellbore magnet tool of claim 1 further comprising a chassis, wherein the chassis is substantially cylindrical, and is positioned within an interior flow bore of the wellbore magnet tool, and wherein the first sensor, the second sensor, and/or the electronics board positioned on an inside surface of the chassis.

3. The wellbore magnet tool of claim 1, wherein the plurality of magnets are distributed about the outer circumference of the wellbore magnet tool in a plurality of magnetic areas, each magnetic area of the plurality of magnetic areas comprising one or more of the plurality of magnets, such that a plurality of non-magnetic areas are provided, with one of the non-magnetic areas distributed about the outer circumference of the wellbore magnet tool between each pair of the magnetic areas of the plurality of magnetic areas.

4. The wellbore magnet tool of claim 1, wherein the first sensor is positioned proximal a first end of the wellbore magnet tool and the second sensor is positioned proximal a second end of the wellbore magnet tool.

5. The wellbore magnet tool of claim 1, wherein the plurality of sensors comprises one or more additional sensors in addition to the first sensor and the second sensor, wherein the one or more additional sensors are electronically connected with the electronics board, and wherein the one or more additional sensors are configured to detect changes in a magnetic field proximate thereto, which changes result from debris collection by the wellbore magnet tool.

6. The wellbore magnet tool of claim 1, wherein the first sensor, the second sensor, or both directly detect Gauss readings or comprise magnetometers.

7. A wellbore magnet tool comprising:

a plurality of magnets positioned about an outer circumference of the wellbore magnet tool;

a plurality of sensors, including: a first sensor proximal one or more of the plurality of magnets; and a second sensor positioned downhole from the first sensor and proximal one or more other of the plurality magnets; and an electronics board;

wherein the first sensor and the second sensor are electronically connected with the electronics board, and wherein the first sensor and the second sensor detect changes in a magnetic field proximate thereto, which changes result from debris collection by the wellbore magnet tool, wherein the changes in the magnetic field detected by the first sensor, the second sensor, or both can be utilized to determine, substantially in real time, if a debris collection capacity of the wellbore magnet tool has been reached or exceeded.

8. The wellbore magnet tool of claim 7 further comprising a chassis, wherein the chassis is substantially cylindrical, and is positioned within an interior flow bore of the wellbore magnet tool, and wherein the first sensor, the second sensor, and/or the electronics board are connected to the chassis.

9. The wellbore magnet tool of claim 8, wherein the first sensor, the second sensor, or both are positioned on an inside surface of the chassis.

10. The wellbore magnet tool of claim 8, wherein the chassis is removably positioned in the interior flow bore of the wellbore magnet tool.

11. The wellbore magnet tool of claim 7, wherein the plurality of magnets are distributed about the outer circumference of the wellbore magnet tool in a plurality of magnetic areas, each magnetic area of the plurality of magnetic areas comprising one or more of the plurality of magnets, such that a plurality of non-magnetic areas are provided, with one of the non-magnetic areas distributed about the outer circumference of the wellbore magnet tool between each pair of the magnetic areas of the plurality of magnetic areas.

12. The wellbore magnet tool of claim 7, wherein the first sensor is positioned proximal a first end of the wellbore magnet tool and the second sensor is positioned proximal a second end of the wellbore magnet tool.

13. The wellbore magnet tool of claim 7, wherein the plurality of sensors comprises one or more additional sensors in addition to the first sensor and the second sensor, wherein the one or more additional sensors are electronically connected with the electronics board, and wherein the one or more additional sensors are configured to detect changes in a magnetic field proximate thereto, which changes result from debris collection by the wellbore magnet tool.

14. The wellbore magnet tool of claim 7, wherein the first sensor, the second sensor, or both directly detect Gauss readings or comprise magnetometers.

15. The wellbore magnet tool of claim 7, wherein the plurality of magnets comprise rare earth bar magnets.

16. A method comprising:

positioning a wellbore magnet tool downhole in a wellbore, wherein the wellbore magnet tool comprises:

a plurality of magnets positioned about an outer circumference of the wellbore magnet tool;

a plurality of sensors, including: a first sensor proximal one or more of the plurality of magnets; and a second sensor positioned downhole from the first sensor and proximal one or more other of the plurality magnets; and an electronics board;

wherein the first sensor and the second sensor are electronically connected with the electronics board, and wherein the first sensor and the second sensor detect changes in a magnetic field proximate thereto, which changes result from debris collection by the wellbore magnet tool;

collecting debris with the wellbore magnet tool; and monitoring a debris collection capacity of the wellbore magnet tool during the collecting of the debris, substantially in real time, by monitoring changes in the local magnetic field detected by the first sensor, the second sensor, or both.

17. The method of claim 16, wherein the electronics board of the wellbore magnet tool is electronically connected to a surface via wired drill pipe (WDP), and/or via measuring while drilling/logging while drilling (MWD/LWD) tool and a surface acquisition system, whereby data from the plurality of sensors is transmitted to the surface.

18. The method of claim 17, wherein the data is transmitted to the surface via mud pulse telemetry.

19. The method of claim 17, wherein the electronics board and/or the MWD/LWD tool further comprises a battery.

20. The method of claim 16 further comprising estimating the debris collection capacity based on the change in the local magnetic field detected by the first sensor, the change in the local magnetic field detected by the second sensor, or the change in the local magnetic field detected by the second sensor relative to the change in the local magnetic field detected by the first sensor.

21. The method of claim 16, wherein the wellbore magnet tool of claim 1 is positioned downhole in the wellbore in conjunction with a bottom hole assembly (BHA), and wherein the method further comprises, upon a determination that the debris collection capacity has been reached or exceeded, performing another operation, wherein the another operation comprises pumping a high viscosity (hi-vis) pill downhole, increasing a flow rate, activating a circulation sub of the BHA, or a combination thereof.

22. The method of claim 21, wherein the another operation is performed without removing the wellbore magnet tool from the wellbore.

23. A method comprising:

removably inserting a chassis into a flow bore of a wellbore magnet tool, wherein the wellbore magnet tool comprises a plurality of magnets positioned about an outer circumference of the wellbore magnet tool, wherein the chassis is substantially cylindrical, and wherein the chassis comprises a plurality of sensors and an electronics board positioned on an inside surface of the chassis, wherein the plurality of sensors include: at least a first sensor proximal one or more of the plurality of magnets; and a second sensor positioned downhole from the first sensor and proximal one or more other of the plurality magnets, and wherein the first sensor and the second sensor detect changes in a magnetic field proximate thereto, which changes result from debris collection by the wellbore magnet tool;

positioning the wellbore magnet tool downhole in a wellbore in conjunction with a bottom hole assembly (BHA) utilized during a milling operation;

collecting debris with the wellbore magnet tool during and/or subsequent the milling operation, wherein at least a portion of the debris is produced by the milling operation; and monitoring a debris collection capacity of the wellbore magnet tool during the collecting of the debris with the wellbore magnet tool, substantially in real time, by monitoring changes in the magnetic fields detected by the plurality of sensors.

24. The method of claim 23 further comprising removing the wellbore magnet tool from the wellbore, removing the chassis from the wellbore magnet tool, and optionally inserting the chassis into another wellbore magnet tool.

25. The method of claim 23, wherein the plurality of magnets are distributed about the outer circumference of the wellbore magnet tool in a plurality of magnetic areas, each magnetic area of the plurality of magnetic areas comprising one or more of the plurality of magnets, such that a plurality of non-magnetic areas are provided, with one of the non-magnetic areas distributed about the outer circumference of the wellbore magnet tool between each pair of the magnetic areas of the plurality of magnetic areas.

26. The method of claim 23, wherein the first sensor is positioned proximal a first end of the wellbore magnet tool and the second sensor is positioned proximal a second end of the wellbore magnet tool.

27. The method of claim 23, wherein the plurality of sensors comprises one or more additional sensors in addition to the first sensor and the second sensor, wherein the one or more additional sensors are electronically connected with the electronics board, and wherein the one or more additional sensors are configured to detect changes in a magnetic field proximate thereto, which changes result from debris collection by the wellbore magnet tool.

28. The method of claim 23, wherein the first sensor, the second sensor, or both directly detect Gauss readings or comprise magnetometers.

* * * * *